US005330713A

United States Patent [19]

Davitz

[11] Patent Number: 5,330,713

[45] Date of Patent: Jul. 19, 1994

[54] GOLD-COLORED ALLOY

[76] Inventor: Daniel Davitz, P.O. Box 385, Morton Grove, Ill. 60053

[21] Appl. No.: 804,803

[22] Filed: Dec. 9, 1991

[51] Int. Cl.[5] ..... C22C 30/02

[52] U.S. Cl. ..... 420/587; 420/582

[58] Field of Search ..... 420/587, 582, 503, 483; 148/419, 442

[56] References Cited

U.S. PATENT DOCUMENTS 1,913,423 6/1933 Wise ..... 420/419

4,557,895 12/1985 Karamon et al. ..... 420/587

FOREIGN PATENT DOCUMENTS 0057149 8/1982 European Pat. Off. .

2739839 3/1979 Fed. Rep. of Germany .

61-067743 4/1986 Japan .

OTHER PUBLICATIONS

Metals Handbook, 9th Ed., vol. 15 pp. 468–470 1988.

*Primary Examiner*—Richard O. Dean

*Assistant Examiner*—Margery S. Phipps

*Attorney, Agent, or Firm*—Michael, Best & Friedrich

[57] ABSTRACT

In accordance with this invention, a gold colored tarnish and corrosive resistant alloy is provided which includes the following: 6 to 20 percent by weight gold, 5 to 10 percent by weight of indium, 5 to 12 percent by weight of palladium, 23 to 40 percent copper, 5 to 10 percent by weight zinc, and 23 to 40 percent by weight silver. It has been found that the aforesaid alloys are sufficiently malleable to be rolled or stamped without fracturing.

11 Claims, No Drawings

GOLD-COLORED ALLOY

BACKGROUND OF THE INVENTION

The present invention relates generally to gold alloys and in particular to a gold alloy that resembles 10 karat gold in color.

A wide variety of U.S. patents have disclosed various gold-color alloys. Included among them are U.S. Pat. Nos.

| | | | |
|---|---|---|---|
| 1,965,012 | 7/1934 | Taylor | 75/1 |
| 3,424,577 | 1/1969 | Nielson et al | 75/134 |
| 3,767,391 | 10/73 | Tuccillo et al | 75/134 |
| 3,925,066 | 3/1981 | Kobru et al | 75/134 |
| 4,255,191 | 3/1981 | Kropp | 75/134 |
| 4,264,399 | 4/1981 | Harris et al | 75/134 |
| 4,350,527 | 9/82 | Davitz | 75/173 |
| 4,370,164 | 1/1983 | Harris et al | 420/503 |
| 4,396,578 | 8/1983 | Bales | 420/58 |
| 4,446,102 | 5/1984 | Bales | 420/507 |
| 4,557,895 | 12/10/1985 | Karmon et al | 420/587 |

In addition, the applicant is the owner of U.S. Pat. Nos. 4,350,527; 4,865,809; 4,948,557; and 5,019,335 which also disclose gold-colored alloys. However, it has been found that the aforesaid alloys are not sufficiently malleable to be rolled or stamped. Alternatively, such alloys that are sufficiently malleable are not corrosion and tarnish resistant.

Accordingly, it is an object of the present invention to provide a gold-colored alloy that is malleable, corrosion-resistant, tarnish-resistant and resembles 10 karat gold in color.

DETAILED DESCRIPTION OF THE PREFERRED EMBODIMENT

In accordance with this invention, a gold colored tarnish and corrosive resistant alloy is provided which includes the following: 6 to 20 percent by weight gold, 5 to 10 percent by weight of indium, 5 to 12 percent by weight of palladium, 23 to 40 percent copper, 5 to 10 percent by weight zinc, and 23 to 40 percent by weight silver.

The preferred alloy percentage by weight is: 10% Au, 7.5% Pd., silver 35.5%, copper 33%, zinc 7%, Calcium Boride as a flux or a deoxidizer, or Copper Boride as a deoxidizer.

Physical properties of this alloy:

Melting point of this alloy is 1280 degrees F. and the casting temperature is 1800 to 1860 degrees F. The hardness is 110 to 142 brinell hardness. Elongation is 18% quenched and 9 percent bench cooled after casting. The color of this alloy is a light yellow as per 10 karat gold. The tensile strength of this alloy is 68000 psi, density of 8.96 g/cc.

The gold and palladium prevent tarnishing and corrosion. This alloy has been tested in a sulfur atmosphere and a chloride atmosphere and is found to be equivalent to a 10 karat gold alloy. Due to the lowering of the indium in comparison to our U.S. Pat. No. 5,019,335, this alloy can be rolled and stamped and rings can be sized one or more sizes.

The above disclosure has been offered for illustrated purposes is not intended to limit the invention of this application, which is defined in the claims below.

What is claimed is:

1. A corrosive and tarnish resistant alloy consisting essentially of 6 to 19.8 percentage by weight of gold, 5 to 12 percentage by weight indium, 6.2 to 12 percent by weight of zinc, 6.2 to 12 percent by weight palladium, 23 to 40 percent by weight copper and 23 to 40 percent by weight silver.

2. The alloy of claim 1 having a casting temperature of 1850 to 1900 degrees F.

3. The alloy of claim 1 having a melting temperature of approximately 1280 degrees F.

4. The alloy of claim 1 wherein said indium and said zinc does not exceed 15 percent by weight in combination.

5. The alloy of claim 1 wherein said alloy has a brinell hardness of between 110 and 142.

6. The alloy of claim 1 wherein said alloy has a specific gravity of approximately 8.96 g/cc.

7. The alloy of claim 4 and further comprising calcium boride.

8. The alloy of claim 4 and further comprising copper boride used as a deoxidizer, said copper boride comprising 2% boron and 98% copper.

9. The alloy in claim 4 in which said palladium and said gold are used to prevent tarnishing.

10. The alloy in claim 4 in which said zinc is used as a scavenger and to color the alloy to a light yellow.

11. A corrosive and tarnish resistant alloy consisting essentially of 19.8 6% to 6.2% by weight of gold, 5% to 12% by weight indium, to 12% by weight palladium, and 23% to 40% by weight copper, said alloy being sufficiently malleable to be rollable and stampable without fracturing.

* * * * *